United States Patent [19]

Watanabe

[11] 4,240,633

[45] Dec. 23, 1980

[54] GAME HAVING MOVABLE OBJECT AND OBJECT STRIKING MEMBER

[75] Inventor: Hiroyuki Watanabe, Tokyo, Japan

[73] Assignee: Tomy Kogyo Co., Inc., Tokyo, Japan

[21] Appl. No.: 46,115

[22] Filed: Jun. 6, 1979

[30] Foreign Application Priority Data

Jun. 12, 1978 [JP] Japan ..... 53-71156

[51] Int. Cl.[3] ..... A63F 7/00; A63F 9/22

[52] U.S. Cl. ..... 273/88; 273/93 R

[58] Field of Search ..... 273/88, 89, 85 R, 93 R

[56] References Cited

U.S. PATENT DOCUMENTS

| | | | |
|---|---|---|---|
| 2,883,193 | 4/1959 | Iannone et al. | 273/88 |
| 2,925,275 | 2/1960 | Schlapa | 273/88 |

*Primary Examiner*—George J. Marlo

*Attorney, Agent, or Firm*—Staas & Halsey

[57] ABSTRACT

A game which can be used by either a sole player or preferably two players using the game in a competitive spirit is constructed to include within a housing a movable member. Upon activation, preferably by the first player, the movable member travels down a guide path from a first position to a second position. The second player then attempts to strike the movable member with a striking member. If the second player's movements are coordinated with the motion of the movable member and the movable member is struck at the appropriate time, a chance wheel is activated. The first player then controls the chance wheel by depressing a chance wheel stopping button which stops the chance wheel such that one of a plurality of indicia is exposed indicating the outcome of the second player's effect on the movable member. This outcome is then recorded on an accumulator for maintaining a record of the game. The movable member and the striking member are operatively connected such that the striking member is only capable of effectively striking the movable member when the movable member is in a predetermined striking position.

23 Claims, 14 Drawing Figures

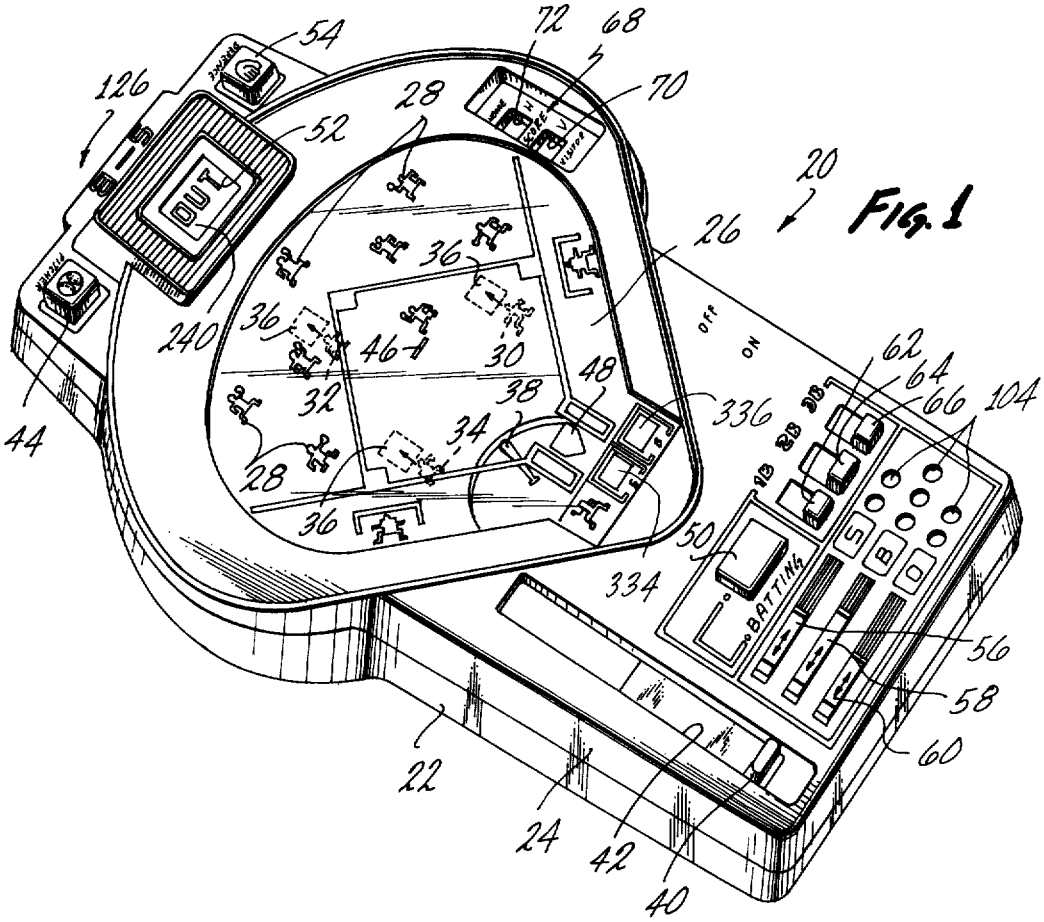
FIG. 1
FIG. 14
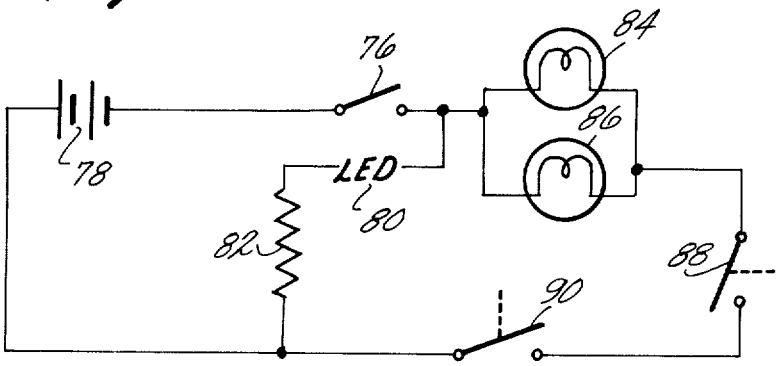

HIT
OUT
3B
B
S
20
22
54
74
76
80
82
84
86
88
40
44
106
108
110
112
114
118
120
122
126
128
130
132
134
144
148
154
156
158
166
168
170
172
176
178
180
182
186
190
194
200
202
204
206
208
210
212
216
240
248
256
264
266
268
270
274
276
282
284
294
298
300
308
310
312
314
316
318
320
328
332
338
340

126

54
52
20
36
72
70
26
32
36
36
96
94
30
34
24
48
92
42
62
50
98
56
100
64
58
66
60
104
104
102

DEFENSE 240
274
280
282
276
278
294
270
290
288
286
272
268
296
292
284
300
304
302
22
298

328
332
86
330
330
326

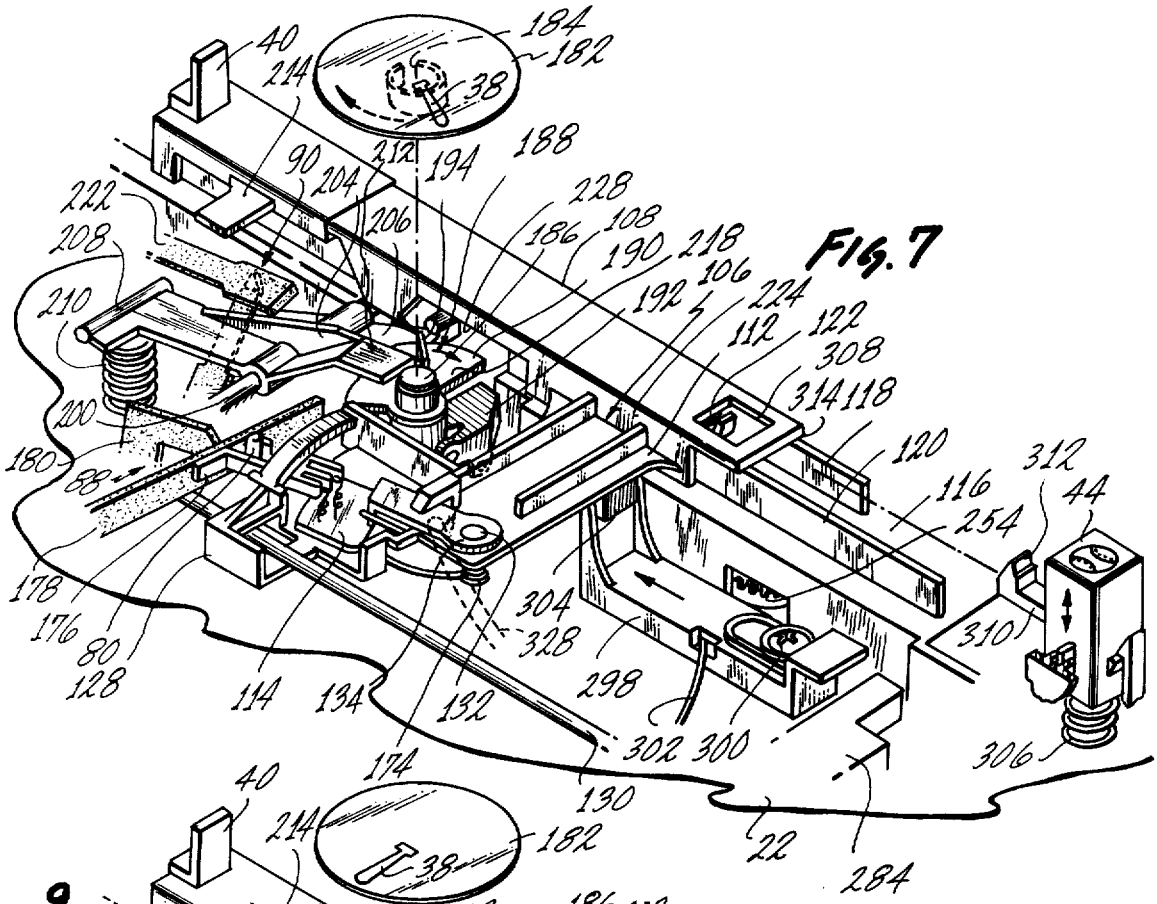
FIG. 7
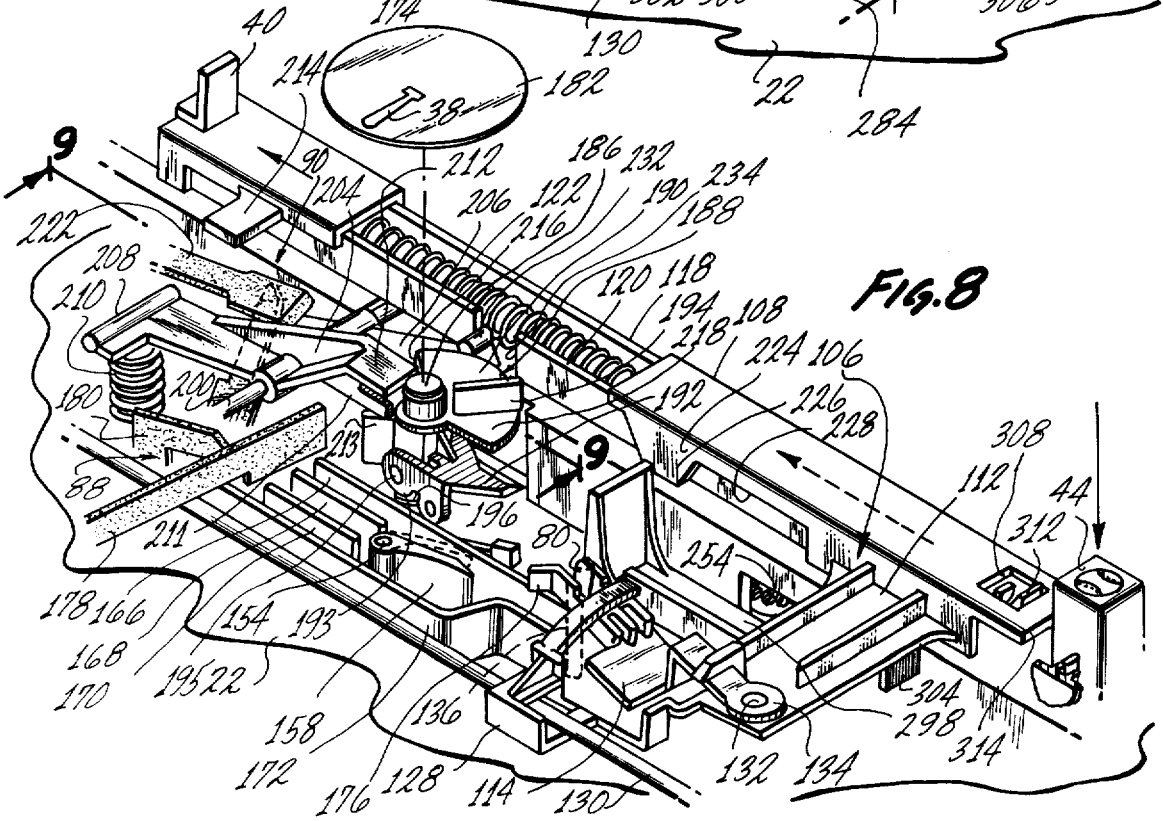

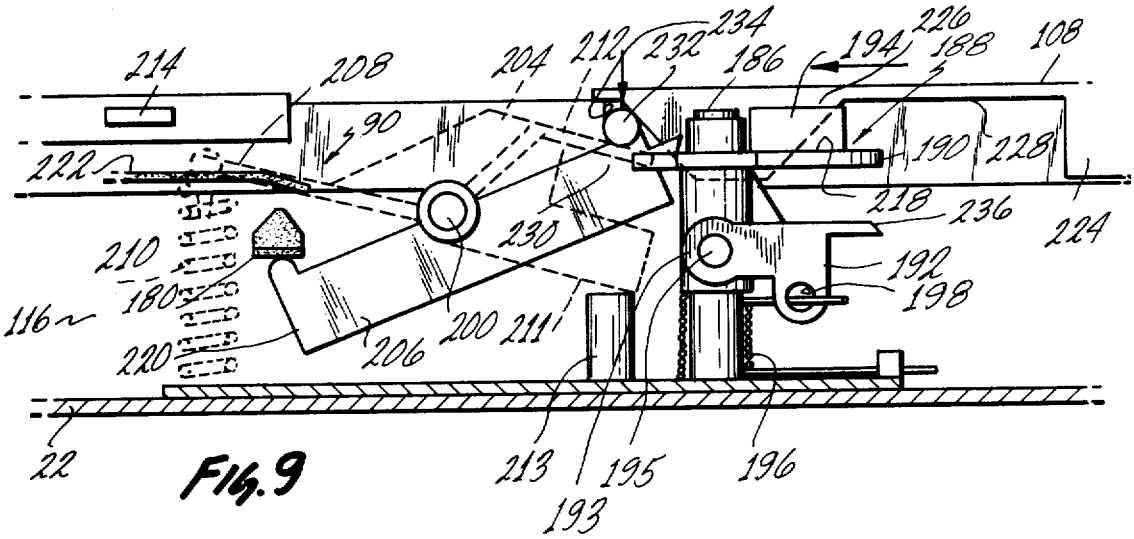
Fig. 9
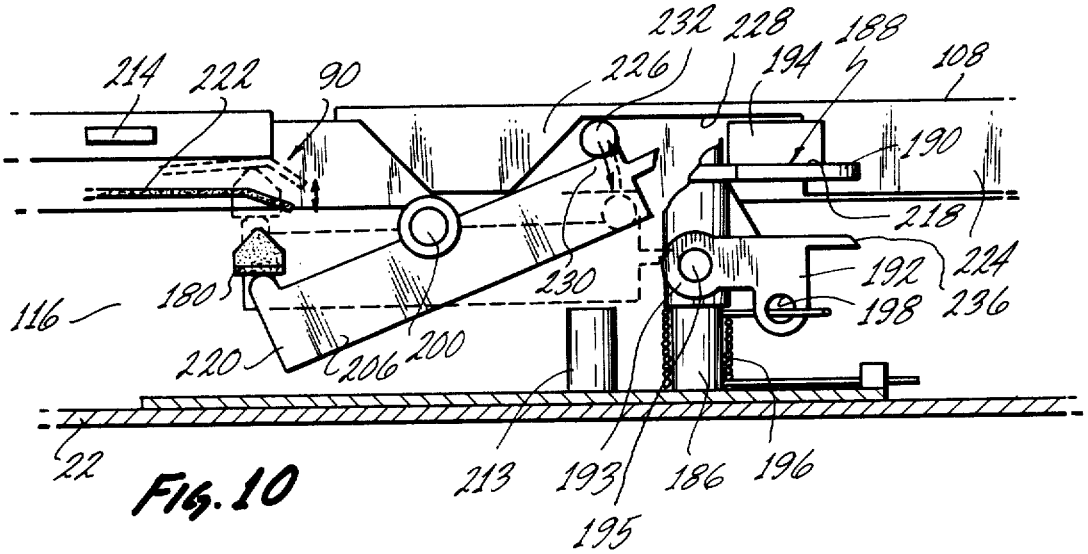
Fig. 10
Fig. 11
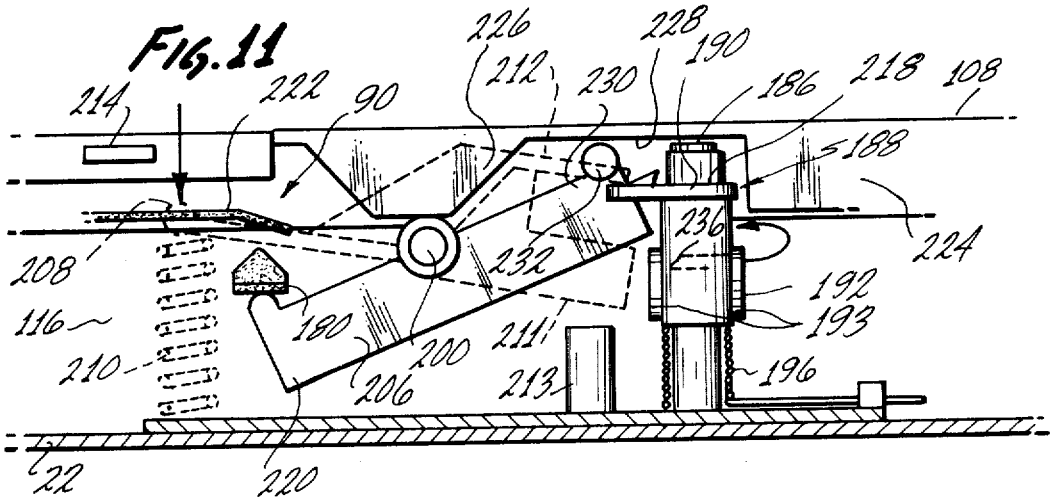

GAME HAVING MOVABLE OBJECT AND OBJECT STRIKING MEMBER

BACKGROUND OF THE INVENTION

A toy game capable of being played by two players has a movable member under the control of a first player and a striking member under the control of a second player. The first player activates the movable member and the second player attempts to effectively interfere with its travel path. If the second player is successful with interfering with the travel path the results of the interference is under the control of the chance wheel. Upon coming to rest the chance wheel indicates the results and they then can be recorded on an accumulator.

With the advent of modern mechanical and electrical technology, devices have been produced which enable a player to mimic certain events such as sporting events like football, baseball and hockey, and other events such as target shooting, war games, etc. Penny arcade devices are available which allow one or more players to compete against either themselves or against the device in a simulated sporting event or other type game. The usual penny arcade device is a large stationary device which, because of its size and complexity, is expensive and thus not available for individual home or portable use.

Recent electrical technology has led to the development of devices which can be attached to TV sets and allow the user to play certain games using the TV screen as the playing board. Because of the necessity of creating an electrical signal which can be utilized by the TV set these devices are generally quite sophisticated and while being less expensive than the penny arcade devices discussed above they still cannot be considered as inexpensive devices. Further, since these devices require the use of a TV set for their function they are not portable and can lead to altercations among family members as to the use of the TV set for TV viewing versus game playing.

Because different individuals have different interests, one game or amusement device may be very appealing to a certain individual and yet hold no interest for a different individual. Further, because sporting events are very seasonal an individual's interest may be successfully held while a particular sporting event is in the limelight, but it may wane during the off-season of that sporting event.

For these reasons it is considered that there exists a need for new and improved amusement devices which are uncomplicated in construction and therefore susceptible to mass production, which are adaptable to simulate different events such as individual sporting events and which are interesting to a large cross-section of ages and thus promote family unity.

BRIEF SUMMARY OF THE INVENTION

In view of the above it is a broad object of this invention to provide a new game which is readily acceptable to the public because it can be used by a large cross section of individuals and because its construction is simple enough to allow mass production. It is an additional object to provide a game which mimics a particular sporting event and thus is interesting and entertaining to those individuals which are interested in that sporting event.

These and other objects which will become apparent from a remainder of this specification are achieved by providing a game preferredly having a baseball theme, which is constructed to include within a housing a movable member. The movable member is located below a screen and includes an object member preferably in the form of a light which, when viewed through the screen, appears as a discreet object such as a baseball. The movable member travels down a guide path from a first position to a second position after being activated by the first player. A striking member under the control of a second player is capable of interacting with the movable member at a particular position. In the preferred embodiment utilizing a baseball game theme this position represents home plate. If the striking member is successfully activated by the second player at the appropriate time, a detection circuit is activated signaling the successful action of the second player. In going from its first position to its second position the movable member activates a chance wheel. A chance wheel stopping mechanism is under the control of the first player and upon deactivation of the chance wheel by the first player, one of a plurality of indicia on the chance wheel is displayed through an appropriate opening in the housing. This indicia then signals the results of a successful play or unsuccessful play by the second player and in the preferred embodiment would be constructed to include suitable commands such as a hit, an out or a home run. The results of the plays by the players are tallied on a plurality of accumulation devices. In the preferred embodiment this would include keeping track of strikes, balls, outs, runs, etc.

An alternate pathway can be provided for the movable member and in the preferred embodiment be placed in the control of the first player which allows the movable member at some point during its travel down the guide path to divert into an alternate pathway and place the movable member in a position such that the striking member is unable to successfully interfere with the moving member no matter what the second player does. In the preferred embodiment this is accomplished by allowing the first player, prior to activating the movable member, to determine whether the movable member will cross the plate and thus be thrown as a strike or whether the movable member will be diverted in its path just before crossing home plate and thus be a ball.

Successful interference by the second player, i.e., striking the ball, is achieved through a combination of mechanical and electrical contacts. The sliding member includes a cam surface which activates a first electrical contact only when the indicator, i.e., a light, on the movable member is in a particular position on the longitudinal travel path of the movable member. A second electrical contact is only activated when the movable member travels down a first pathway, i.e., a pathway across home plate through "the strike zone". If a portion of the movable member is diverted from this first pathway the second electrical contact is not closed. Both electrical contacts are wired in series and therefore both contacts have to be simultaneously closed in order for a successful interference between the striking member and the movable member to be achieved.

BRIEF DESCRIPTION OF THE DRAWINGS

The invention described in this specification is best understood when taken in conjunction with the drawings wherein:

FIG. 1 is an oblique view of the game showing the outside surface of the upper housing wherein all the player-controlled components are located; FIG. 7 is an oblique view of certain working components located on the left side of FIG. 2; and FIG. 8 is an oblique view of the same components shown in FIG. 7; however, they are shown in a different working orientation with respect to the orientation shown in FIG. 7; and FIG. 9 is a partial side elevation of certain components taken at line 9—9 of FIG. 8 with certain overlaying components shown in phantom; and FIG. 10 is a partial side elevation similar to FIG. 9 except showing certain of the components in a different orientation with respect to one another in addition to having alternate position of other components shown in phantom; and FIG. 11 is a side elevational view similar to FIG. 9 except certain components are shown in a different orientation than that shown in FIGS. 9 and 10 and an overlaying component is shown in phantom; FIG. 14 is a circuit diagram of the electrical circuit of the game.

Figure 2:
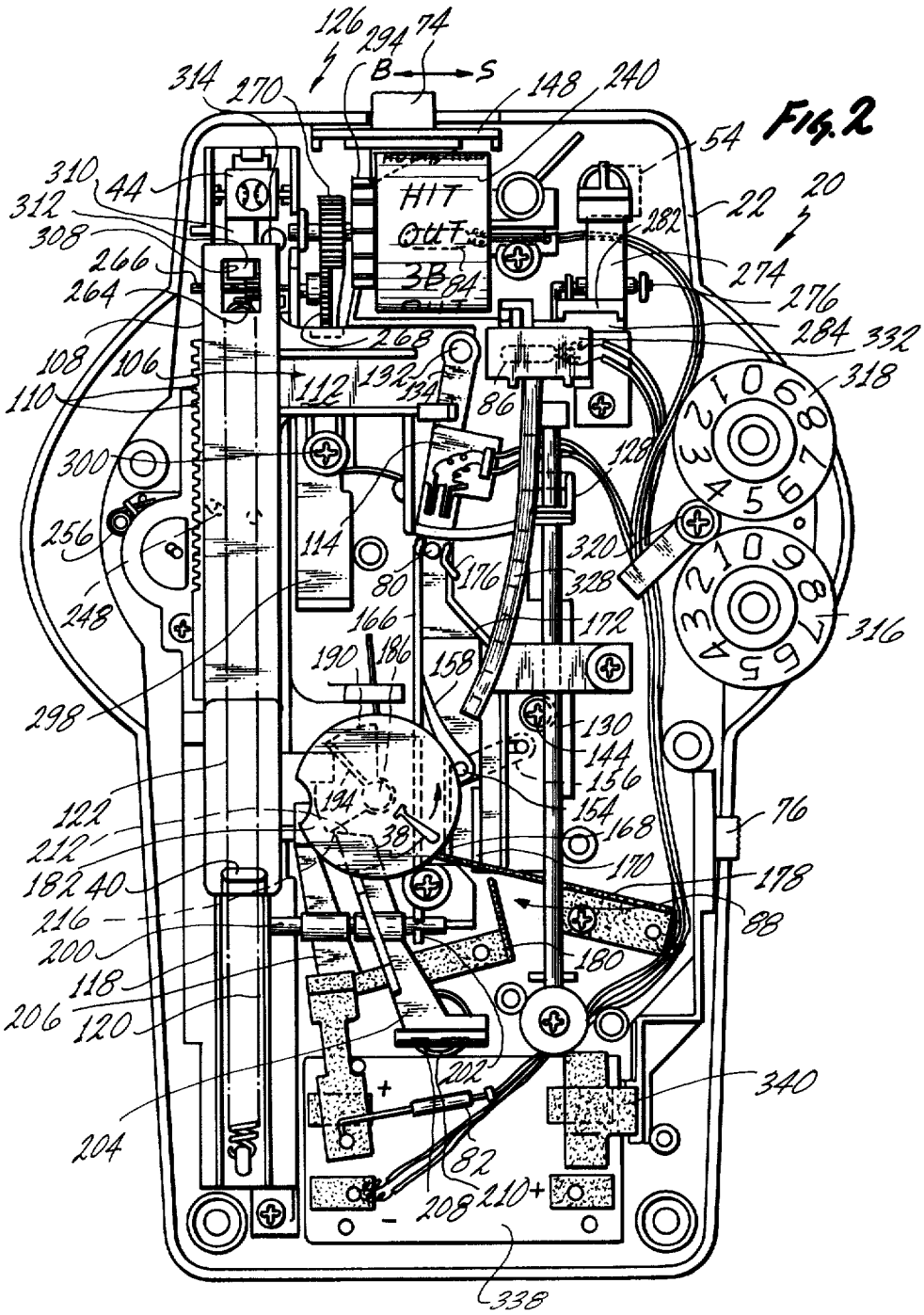
FIG. 2 is a top plan view of the game shown in FIG. 1 with the top housing removed exposing certain of the mechanical components of the game.

The invention illustrated in the drawings and described in the specification is constructed using certain operative principles and concepts which are set forth and defined in the appended claims. Those skilled in the art in which this invention relates to will realize that these principles and concepts could be utilized in a number of differently appearing embodiments. For this reason this invention is not to be construed as being limited to the preferred embodiment illustrated herein, but is to be construed in light of the appended claims.

DETAILED DESCRIPTION

The game 20 is located within a lower housing 22 and an upper housing 24 which are mated together by appropriate screws (not shown or numbered) traversing through the lower housing 22 into the upper housing 24. Located in the center of the upper housing 24 is a transparent screen 26 which allows certain of the components within the interior of game 20 to be viewed from the exterior of the game. A collection of stationary FIGS. collectively identified by the numeral 28 are appropriately painted on the screen 26. Three movable FIGS., first base FIG. 30, second base FIG. 32 and third base FIG. 34 are connected to components hereinafter described which allow them to be selectively hidden or exposed through three viewing windows collectively identified by the numeral 36 in screen 26. Also exposed through viewing screen 26 is a striking element preferredly in the shape of a bat 38, the function of which will be described hereinafter.

Located in the lower left hand corner of upper housing 24 is a reset lever 40. To activate the game the reset lever 40 is displaced from the position in which it is shown in FIG. 1 up along the groove 42 in top housing 24 to a position proximal to screen 26. After the reset lever 40 is activated a first player can start the game by depressing pitch button 44 located in the upper left hand corner by the upper housing 24. When button 44 is depressed reset lever 40 descends down groove 42 and certain other internal parts hereinafter described also are activated. Among these is a light (not visible in FIG. 1) which travels from a position proximal to the pitcher's rubber 46 printed on screen 26 toward home plate 48, also printed on screen 26.

The bat 38 is activated by depressing batting button 50 located below home plate 48. If the player in control of batting button 50 is successful in hitting the ball as hereinafter described a second light (also not seen in FIG. 1) is lit underneath screen 26. Concurrently a third light (also not seen in FIG. 1) is lit exposing the surface of a chance wheel (hereinafter numbered) through viewing window 52. The first player or pitcher then depresses defense button 54 located in the upper right hand corner of upper housing 24. This stops the chance wheel and the results of the particular play is then exposed through view window 52. As shown in FIG. 1 the play displayed is that of an "out". Other plays located on the chance wheel would include appropriate plays such as a first base hit, a second base hit, a third base hit, and a home run.

Located near the bottom of lower housing 22 are a series of buttons or accumulators which allow the players to keep track of the strikes—button 56; the balls—button 58; and the outs—button 60. Located next to the aforementioned buttons are a second series of buttons or accumulators—buttons 62 through 66 which control the first, second and third base FIGS. 30 through 34 respectively. The players keep track of their hits, "doubles", etc. by exposing the appropriate FIGS. 30 through 34 with the use of the buttons 62 through 66. When a player has advanced one of the FIGS. past all of the bases a run is tallied on the score indicator 68, or accumulator, located on the right hand side of the upper housing 24. The score indicator contains two viewing windows 70 and 72 for keeping track of the separate scores of the home team and the visiting team—i.e., the first and second player.

Not seen in FIG. 1, but shown in FIG. 2, is a ball strike button 74 located in lower housing 22, the function of which will be described hereinafter. An appropriate designation for balls and strikes is molded into the upper housing 24. Not seen in FIG. 1, but shown in FIG. 2 on the right hand side of the game 20 is an off-on button 76. Also appropriately molded in upper housing 24 are the designations "off" and "on". The off-on button controls the electrical circuit and of course is turned on prior to play of the game 20.

FIG. 14 shows a circuit diagram of the electrical components of the game 20. For the purposes of clarity in this specification, some of the same numerals will be used to designate the parts in the circuit diagram as is used to designate its mechanical equivalent. The circuit consists of a battery 78 connected in series with off-on switch 76. A light emitting diode, hereinafter referred to as LED 80 is placed in circuit with switch 76 and is protected by resistor 82. Wired in parallel together and also in parallel with LED 80 are lights 84 and 86. The circuits for lights 84 and 86 includes in series two switches 88 and 90. For lights 84 and 86 to be energized both switches 88 and 90 must be simultaneously closed. The function of the lights 84 and 86 and the switches 88 and 90 will be more fully explained after their mechanical equivalents of switches 88 and 90 are described.

Figure 3:
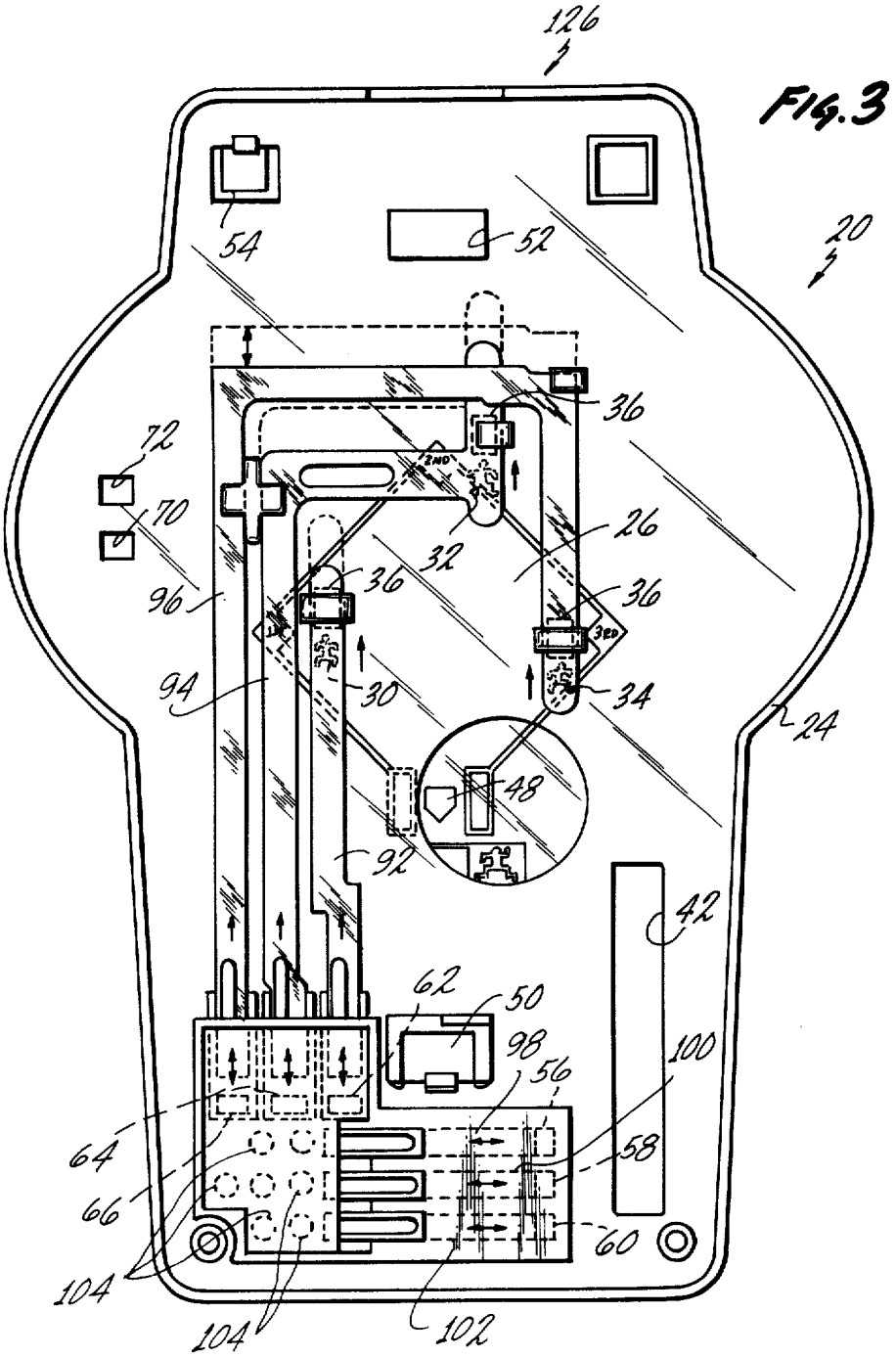
FIG. 3 is a bottom plan view of the top housing showing the underside of the housing and the components located thereon.

FIG. 3 shows the underside of upper housing 24. Operatively connected to button 62 is a metal strip 92. Metal strip 92 slides in an appropriate guide strip (not numbered) which is part of screen 26. The first base FIG. 30 is painted on the upper surface of metal strip 92 and can be alternately exposed to viewing through the appropriate view windows 36 by movement of button 62. Two other metal strips 94 and 96, different in shape from metal strip 92, but identical in function, are attached to buttons 64 and 66. Second base FIG. 32 is painted on the upper surface of metal strip 94 and third base FIG. 34 is painted on the upper surface of metal strip 96. These two FIGS. are exposed through their appropriate view windows 36 by sliding buttons 64 and 66.

Buttons 56, 58 and 60 are attached to metal strips 98, 100 and 102 respectively. The upper surface of the metal strips 98, 100 and 102 are painted such that when a button, e.g., button 56, is slid within the upper housing 24 a portion of the upper painted surface of the metal strip is exposed to viewing through one of the holes collectively identified by numeral 104 which are found in upper housing 24. If a player who is at bat, that is, the player who is in charge of batting button 50, pushes the batting button and misses the ball as hereinafter described, the player then pushes button 56 such that the first of one of the holes 104 corresponding to strike symbol printed on the upper surface of housing 24, is colored by exposure of a portion of the painted metal strip 98. After a second strike the second hole would be colored. The ball and the out buttons 58 and 60 are used in a like manner.

Figure 13:
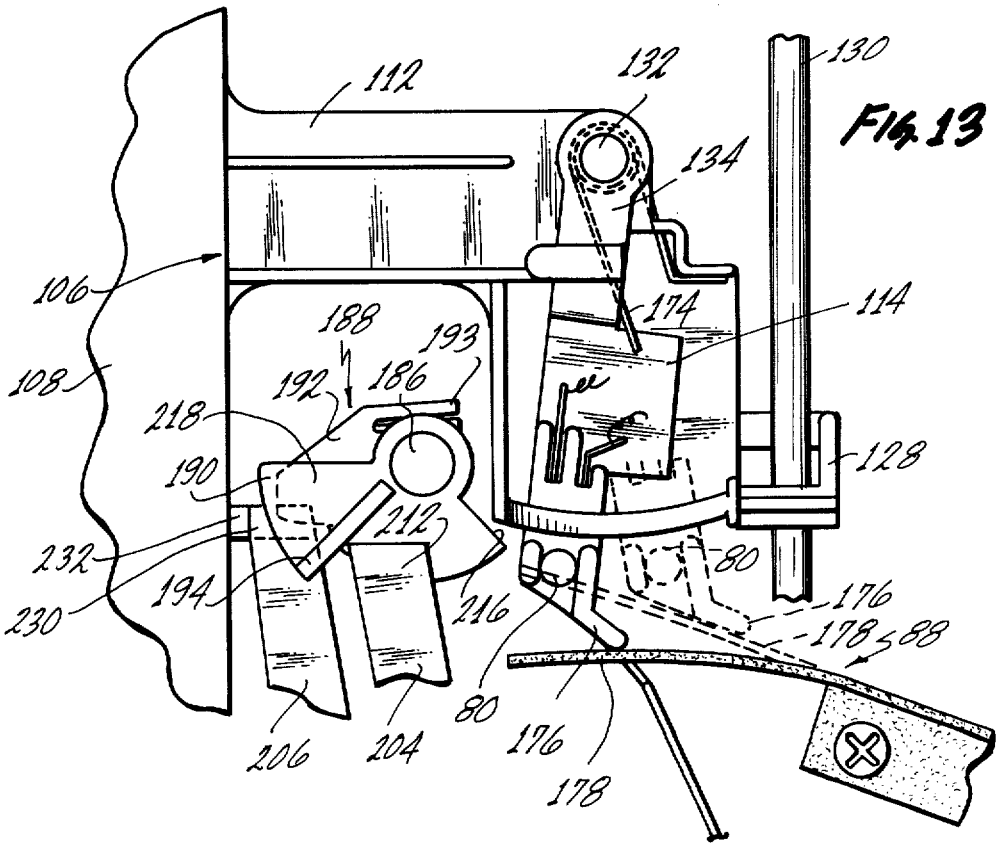
FIG. 13 is a plan view of certain components located near the left central portion of FIG. 2 with alternate position of certain of the components shown in phantom.

A movable member 106 best seen in FIGS. 2, 7, 8 and in part in FIG. 13 is adapted to slide along the longitudinal axis of the toy 20. The movable member 106 is a compound member composed of an elongated U-shaped sliding section 108 having a rack of gear teeth 110 on one side thereof and a transverse arm 112 projecting from the sliding section 108. Further, attached to the transverse arm section 112 is a compound bracket section 114. An elongated hollow member 116 is attached to lower housing section 22 near its left hand side. The sliding section 108 of movable member 106 is shaped to fit over the top of two elongated longitudinal flanges 118 and 120 formed on member 116 which serve as a track for the movable member 106. A spring 122 is connected between the surface of hollow member 116 and sliding section 108 and serves to bias the movable member 106 in a downward direction toward the bottom end 124 of the game 20. Reset lever 40 also slides along the flanges 118 and 120 of hollow member 116 and is used to push movable member 106 against the bias of spring 122 toward the top end 126 of the game 20.

The bracket section 114 of movable member 106 contains a cut-out 128 which travels along a rod 130. Rod 130 serves a as a right side rail for movable member 106 and the flanges 118 and 120 serve as left side rail. This maintains the proper alignment of movable member 106 within the lower housing 22 of the game 20. The rod 130 is appropriately mounted on mounting projections (not separately numbered or identified) projecting out of the surface of lower housing 22.

A ped 132 extends upwardly from the transverse arm 112. Mounted within bracket section 114 is a swivel arm 134. Swivel arm 134 contains an appropriate bearing surface (not separately numbered or identified) which fits around peg 132 and allows swivel arm 134 to swivel within bracket section 114. Mounted on swivel arm 134 is LED 80. Projecting from the bottom surface of the leading edge of swivel arm 134 is a guide peg 136 which is seen in phantom in FIG. 8 and in section in FIG. 4.

Figure 4:
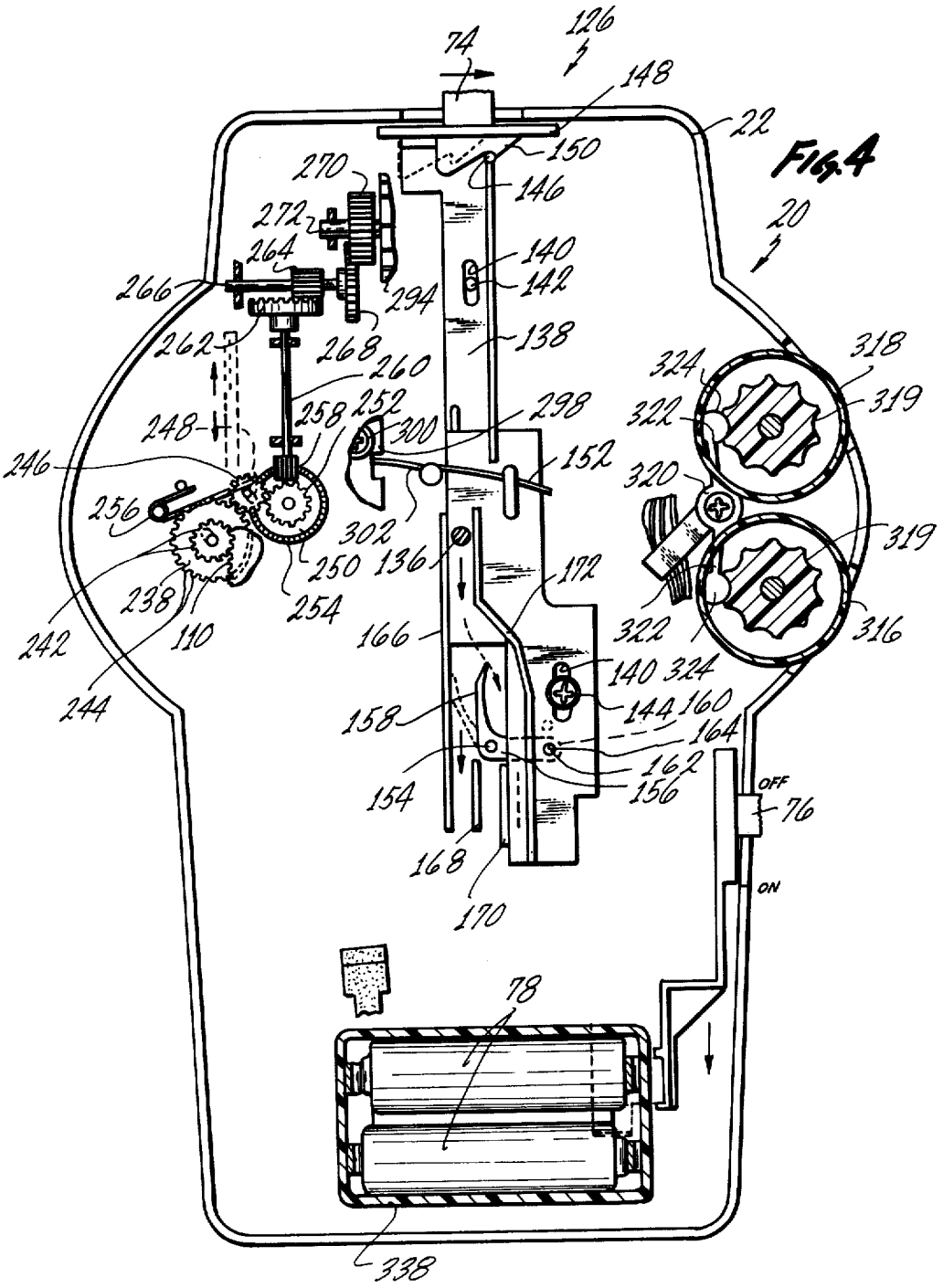
FIG. 4 is a plan view in partial section similar to FIG. 2 except many of the overlying components have been removed to expose underlying components.
Figure 5:
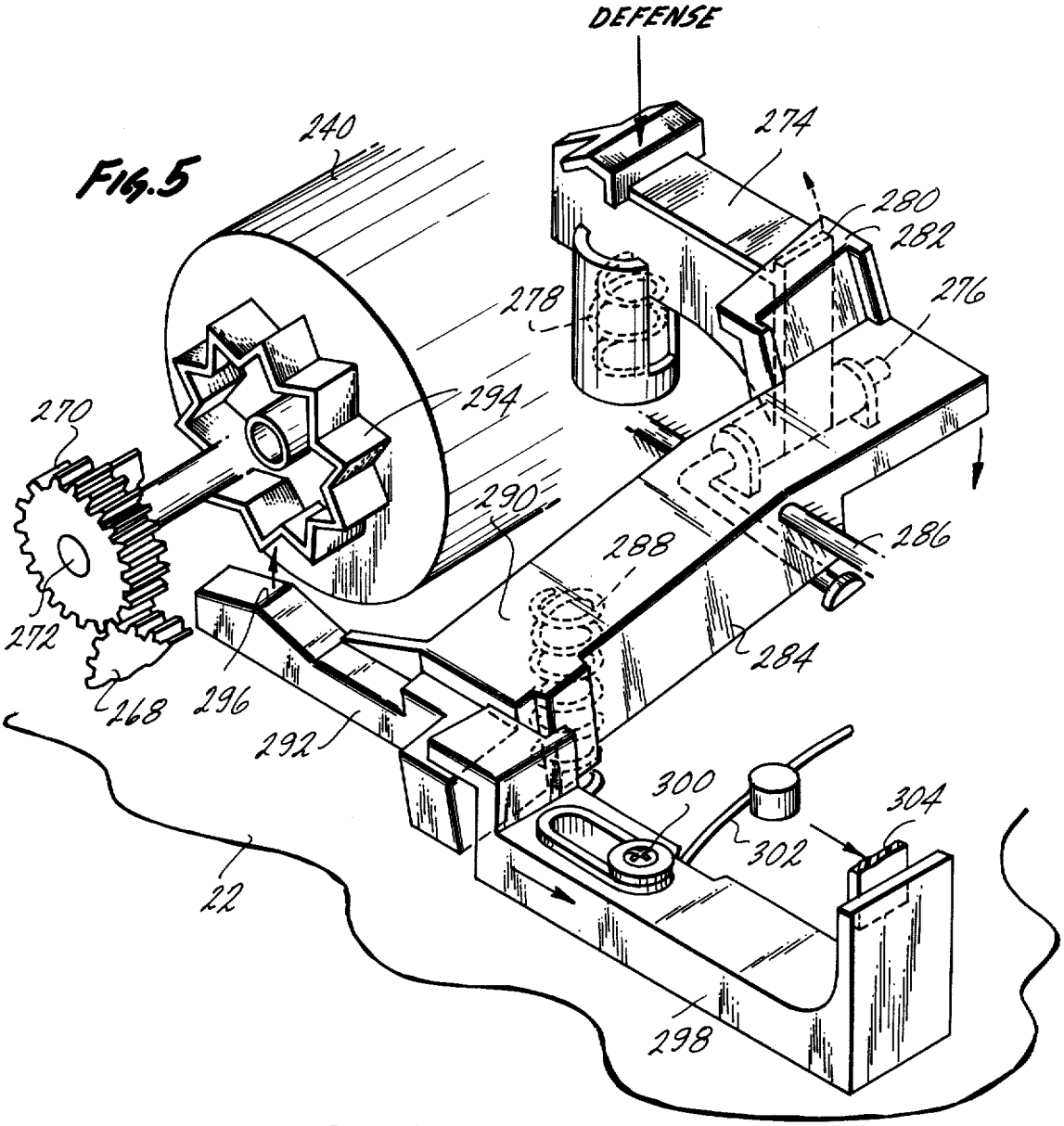
FIG. 5 is an oblique view showing the stopping mechanism for the chance wheel located in the upper portion of the housing shown in FIG. 2.

Referring now to FIG. 4 resting on the surface of lower housing 22 is a guide member 138. Guide member 138 contains two slots, both collectively identified by the numeral 140. One of these slots rests over peg 142 projecting out from lower housing 22. A second peg (not seen or numbered) projects through the other of the slots 140 and has a flanged head screw 144 screwed into it which maintains guide member 138 in its appropriate position in lower housing 22.

A shifting peg 146 integrally formed with guide member 138 proximal to end 126 of the game 120 projects in an upward direction. Ball strike button 74 is attached to a shifting member 148 which has a cam-shaped projection 150 positioned to fit against shifting peg 146. A spring 152 biases guide member 138 toward end 126 causing shifting peg 146 to rest snugly against cam-shaped projection 150. When shifting member 148 is in the position shown in solid lines in FIG. 4 the interaction of the cam-shaped projection 150 and the shifting peg 146 causes guide member 138 to be slightly displaced toward end 124. When the shifting member 148 is in the position shown in phantom lines in FIG. 4 the shifting peg 146 slides along the cam-shaped projection 150 and causes guide member 138 to be displaced slightly toward end 126.

Projecting from the surface of lower housing 22 is peg 154. A switching member 156 fits over peg 154 and is free to rotate about this peg. Switching member 156 is composed of a switching arm 158 and a control arm 160. Control arm 160 fits underneath guide member 138 and has a small upstanding peg 162 on its end thereof. Peg 162 loosely fits in a slot 164 in guide member 138. As guide member 138 slides back and forth toward ends 124 and 126 the interaction of peg 162 in slot 164 causes the switching member 156 to rotate about peg 154 such that switching arm 158 moves from the position shown in solid lines in FIGS. 4 and 8 to the position shown in phantom lines in FIGS. 4 and 8.

Three longitudinally extending ribs 166, 168 and 170 are integrally formed and extend upward from lower housing 22. Rib 166 is longer than the other two ribs and in part mates against guide member 138. Guide member 138, however, is free to slide along rib 166. When in the phantom position shown in FIG. 4, switch arm 158 rests against rib 166. A guide member rib 172 extends along the upper surface of guide member 238. This rib 172 is curved as is best seen in FIG. 4.

Guide peg 136 travels along a pathway having several branches which are defined by the ribs 166, 168, 170 and 172 in conjunction with switch arm 158. When switch arm 158 is in the position shown in FIG. 4 in solid line, guide peg 136 would initially start its travel down the path defined by the portions of ribs 166 and 172 nearest end 126. It would then continue down against rib 166 between it and switch arm 158 and finally be located in the path between ribs 166 and 168. This is essentially a straight path and is hereinafter defined as the strike path. If switch arm 158 is in the position shown in phantom in FIG. 4 guide peg 136 would be deflected by arm 158 and would run essentially along the surface of rib 172 and at the limit of its travel closest to end 124 would be in the pathway defined by ribs 170 and 172. This alternate pathway will hereinafter be described as the "ball pathway" or a miss pathway. As seen in FIG. 13 a spring 174 biases swivel arm 134 toward the left hand side of bracket section 114. This results in guide peg 136 also being biased against rib 166 in the strike pathway and against switching arm 158 and rib 170 in the ball pathway.

Projecting from the end of swivel arm 134 is a contact activating surface 176. This contact activating surface 176 is spacially arranged such that when guide peg 136 is in the strike pathway the contact surface 176 extends at an oblique angle from the longitudinal axis of the toy 20. However, when the guide peg 136 is in the ball pathway the contact surface 176 extends almost transverse to the longitudinal axis of the game 20. If, as best seen in FIG. 13, at the end of the travel of the movable member 106 the guide peg is in a strike pathway, the contact surface 176 meets with a flexible contact strip 178 forming a part of switch 88 and forces this contact strip against the right hand side of a second flexible contact strip 180 which serves as part of both switches 88 and 90. This closes the electrical circuit through switch 88. When the guide peg 136 follows the ball pathway the contact surface 176 is deflected such that this surface does not displace contact strip 178 and no electrical circuit through switch 88 is formed. Thus, in FIG. 13 contact strip 178 as shown in solid line completes an electrical circuit and contact strip 178 as shown in phantom line does not complete the electrical circuit.

As hereinafter explained, the batting mechanism is under control of the second player, while the pitching mechanism is under the control of the first player. Further, the ball strike button 74 is also under control of the first player. If the first player switches the ball strike button to the ball mode, no matter what player number two does, the guide peg 136 will always travel down the ball pathway and switch 88 will never be closed, and as such, an electrical circuit through lights 84 and 86 will never be completed.

A round clear plastic disk 182 having bat 38 imprinted on the surface thereon has a round flange (not separately numbered) projecting from its bottom-most surface (not separately numbered) which has a key slot 184 therein. A bat member retention peg 186 projects upwardly from lower housing 22. A bat member 188 fits over retention peg 186 and is free to swivel thereon. The bat member 188 is composed of two sections—a release section 190 and a selector section 192. A rib 194 extends from the top surface of release section 190 and serves as an orientation rib for key slot 184. Disk 182 fits on the top of release section 190 and is fixedly held in place in respect to release section 190 by the interaction of key slot 184 and rib 194. As bat member 188 swivels about bat member retention peg 186 its motion is transferred to disk 182 and thus to bat 38. The motion of bat 38 is therefore governed by the motion of bat member 188.

Selector section 192 of bat member 188 is pivotally attached to release section 190 by two bearing sections 193 on section 192 which fit over two bosses 195 on section 190. A spring 196 is mounted around peg 186 and one end of this spring 196 is threaded through a hole 198 in selector section 192. The other end of spring section 196 is fixedly held against the surface of lower housing 22 by an appropriate projection (not separately numbered or identified). Spring 196 serves two functions. First, it biases bat member 188 in a counterclockwise direction about peg 186. Secondly it biases selector section 192 in an upward direction about release section 190.

An axle 200 extends between hollow member 116 and a support peg 202 projecting upwardly from the surface of lower housing 22. An activating lever 204 fits about axle 200 proximal to support peg 202. A contact lever 206 fits on axle 200 proximal to hollow member 116. Both of levers 204 and 206 are free to swivel about axle 200 independently. One end 208 of lever 204 is biased in an upward direction by compression spring 210. The opposite end 212 of lever 204 is positioned near release section 190 of bat member 188. When reset lever 40 is slid toward end 126 an arm 214 integrally formed with reset lever 40 abuts against rib 194 and causes the bat member 188 to be rotated clockwise against the bias of spring 196. When the reset lever 40 reaches the end of its travel toward end 126, release section 190 has been rotated clockwise to such an extent that end 212 of lever 204 can descend along an edge 216 of release section 190 in a downward direction. Because compression spring 210 is pushing up on end 208 of lever 204, end 212 of lever 204 will always descend if allowed to until a finger 211 on lever 204 abuts against a boss 213 projecting from lower housing 22. The interaction of end 212 of lever 204 against edge 216 of release section 190 locks bat member 188 in a position as shown in FIG. 8. Batting button 50 is so positioned in upper housing 24 that it contacts end 208 of lever 204. When batting button 50 is depressed this movement is transferred to lever 204 causing it to pivot about axle 200 such that end 212 lifts free of edge 216 and allows bat member 188 to rotate counterclockwise. After a counterclockwise rotation the end 212 will rest on the top surface 218 of release section 190 under the bias of compression spring 210 as is shown in FIG. 7.

An end 220 of contact lever 206 fits underneath the left-hand side of contact strip 180 and the flexibility of contact strip 180 biases this end downward. When lever 206 is pivoted about axle 200 end 220 pushes the left-hand side of contact strip 180 upward against its bias allowing it to make electrical contact with a third flexible strip 222. Thus, the left side of contact strip 180 and contact strip 222 form switch 90.

Side 224 of sliding section 108 contains a cam surface 226 and a cut-out section 228 adjacent to the cam 226. The other end 230 of contact lever 206 has a round cylindrical section 232 which is capable of fitting into a notch 234 in the surface of hollow member 116. As sliding section 108 moves along flanges 118 and 120, cam 226 comes in contact with cylindrical section 232 on end 230 of lever 206. When contact is made the cam 226 depresses the cylindrical section 232 causing lever 206 to rotate about axle 200. The opposite end 220 then lifts the left-hand side of contact strip 180 and makes an electrical contact between contact strip 180 and 222.

In FIG. 9 lever 204 is shown in dotted lines and lever 206 is shown in solid lines. In this figure cylindrical section 232 is just mating with cam 226 as sliding section 108 is moving to the left. If bat member 188 is locked in position by the interaction of end 112 of lever 204 with edge 216 of release section 190, and sliding section 108 moves along the flanges 118 and 120, the cam 226 will depress the cylindrical section 232 on lever 206 and pass over it. After the cam surface 226 has passed over the cylindrical section 232 the end 230 of arm 206 will travel upward such that the cylindrical section 232 is within the notch 234 of side 224. Contact strip 180 being flexible serves as a spring depressing end 220 of lever 206 which biases the other end 230 and its attaching cylindrical section 232 in this upward manner.

When batting button 50 is depressed, lever 204 releases bat member 188 and allows it to rotate in a counterclockwise direction. If bat member 188 is allowed to rotate either before or after cam 226 depresses cylindrical section 232, then after rotating counterclockwise selector section 192 will come to rest such that the front edge 236 on selector section 192 will assume a rest position below end 230 of lever 206. If, however, the bat member 188 is released while cylindrical section 232 on the end 230 of lever 206 is depressed by cam 226, then edge 236 on selector section 192 will come to rest over end 230 of lever 206 and even after the cylindrical section 232 is free of the cam 226 end 230 of lever 206 will not be allowed to rise. This locks lever 206 in the position shown in FIG. 12 and as a consequence maintains electrical contact between the left side of contact strip 180 and contact strip 122, the ultimate effect being that switch 90 is maintained in a closed position.

In FIG. 10 end 230 of lever 206 was initially depressed by the interaction of cam 226 with cylindrical section 232 resulting in the closing of switch 90; i.e., interaction of contact strip 180 with contact strip 222 shown in phantom lines; however, the bat member 188 was not released and as such, lever 206 after rotating about axle 200 assumed its initial position shown in solid lines resulting in the reopening of switch 90. In FIG. 11 the bat member 188 was activated prior to depression of end 230 of lever 206 and as such even though switch 90 was momentarily closed, it was reopened. In the case illustrated by FIG. 11 when end 230 of lever 206 is depressed by cam 226, it presses down on edge 236 of selector section 192 and rotates selector section 192 downward about bosses 213 on release section 190 against the bias of spring 196.

Figure 12:
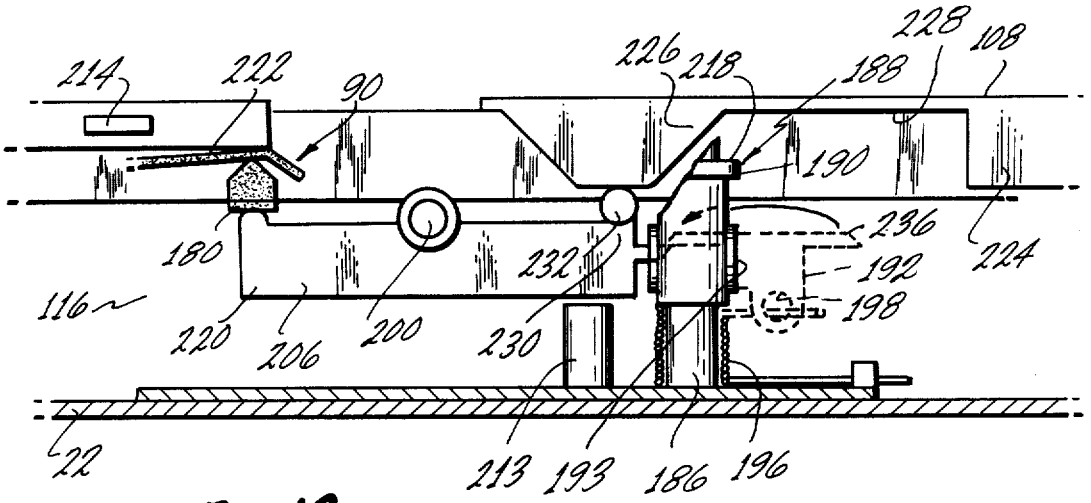
FIG. 12 is a parital side elevational view similar to FIG. 9 except showing certain of the components in a different orientation with respect to one another and an alternate position of one of the components is shown in phantom.

In FIG. 12 bat member 188 was simultaneously allowed to rotate as the cylindrical section 232 of lever 206 was depressed by the cam 226 and lever 206 is locked in this position by end 230 of lever 206 being trapped under edge 230 of selector section 192. As such the contact between the left-hand side of contact 180 and contact 222 is maintained even after the cylindrical section 232 no longer is in contact with the cam surface 226. In effect if the bat member 188; i.e., the bat in the preferred embodiment—is activated prior to or after the precise time the movable member 106 is in position such that the LED 80; i.e., the baseball, is crossing home plate, switch 90 is not maintained in a closed position and the player having control of the batting button 50 makes a "strike" instead of a "hit".

Proximal to end 126 of game 20 is chance wheel 240. Each time the movable member 106 descends from end 126 toward end 124 the chance wheel 240 is sent spinning by a series of gears that are activated by the rack of gear teeth 110 on the left side of sliding section 108. Inside of hollow member 116, as is best seen in FIG. 4, is a gear 238 having a set of pinion teeth 242 and a set of spur teeth 244. The pinion teeth 242 are exposed through the top of the hollow member 116 and are positioned such that they intermesh with the rack of gear teeth 110. A small pinion gear 246 is mounted within hollow member 116 in two slots (one slot 248; the other one not shown or numbered). The uppermost of these, slot 248, is shown in phantom in FIG. 4. The slots allow pinion 246 to move but they are located such that pinion 246 is always in contact with gear 238. A compound gear 250 having a set of pinion teeth 252 and a set of crown teeth 254 are mounted such that the pinion teeth 252 are in a position proximal to pinion gear 246. A small spring 256 biases the axle on which pinion 246 is integrally formed such that pinion 246 is normally held against the pinion teeth 252.

When the sliding section 108 of movable member 106 is being slid toward end 126, the rack of gear teeth 110 causes gear 238 to rotate counterclockwise. This rotation rolls pinion 246 against the bias of spring 256 in the slots 248 such that pinion 246 no longer makes contact with pinion teeth 252. If, however, the movable member 106 is sliding toward end 124, gear 228 is rotated clockwise which rolls pinion 246 against pinion 252. This allows spring 256 to maintain pinion 246 meshed with both spur teeth 244 and pinion teeth 252; thus, when the movable member 106 is moving from end 126 toward 124 its motion is transferred to compound gear 250, but when it is moving in the opposite direction its motion is not transferred to compound gear 250.

A pinion 258 mounted on an axle 260 meshes with crown teeth 254 and transfers motion to crown wheel 262 fixedly attached to the other end of axle 260. Crown wheel 262 meshes with and transfers motion to pinion 264 which in turn transfers motion via axle 266 to spur gear 268. Spur gear 268 interacts with large pinion 270 mounted on axle 272. Also mounted on axle 272 and fixed to pinion 270 is chance wheel 240. Chance wheel 240 is caused to rotate ultimately by the movement of movable member 106. After the movable member 106 ceases its travel in the direction of end 124, the chance wheel continues rotating as well as all of the gears between compound gear 250 and large pinion 270. The rotary motion, however, is broken by pinion 246 which because it is now rotating in a counterclockwise direction tends to rotate on spur teeth 244 against the bias of spring 256 and away from the surface of pinion teeth 252.

If the player in charge of batting button 250 does not depress the button or depresses it at the wrong time, as discussed above, closing switch 90 simultaneously with closing switch 88, lights 84 and 86 are not lighted and the spinning motion of chance wheel 240 is not visible through view window 252. As such the momentum imparted to chance wheel 240 by the movement of movable member 106 is soon lost and the chance wheel ceases rotating.

The chance wheel, however, can be manually stopped by depressing the defense button 54. Defense button 54 fits over the surface of and interacts with a lever 274. Lever 274 is appropriately mounted in the lower housing 22 such that it swivels about an axle 276. Normally a compression spring 278 biases lever 274 upward such that the corner 280 of lever 274 can fit underneath a shoulder 282 of a lever 284. Lever 284 pivots about an axle 286 which is appropriately mounted in some projections (not numbered or identified) projecting from the surface of lower housing 22. A compression spring 288 is placed under an end 290 of lever 284. This forces shoulder 282 down onto the corner 280 of lever 274. Integrally formed with and projecting transversely to the axis of lever 284 is arm 292. Mounted around chance wheel 240 is a ratchet surface 294. A pointed projection 296 on arm 292 is capable of interacting with ratchet surface 294 and stopping the motion of chance wheel 240. When defense button 54 is depressed corner 280 moves out of shoulder 282 allowing lever 284 to swivel under the bias of spring 288 such that the pointed projection 296 moves up against and interacts with ratchet surface 294.

The defense button 254, however, will only stop chance wheel 240 when movable member 106 is at the end of its travel toward end 124 and is in fact at rest near end 124 because of the interaction of a locking member 298 with lever 284. Locking member 298 is slidably mounted on lower housing 22 via a screw 300. A spring 302 biases locking member 298 toward end 126, and this is its normal rest position. When movable member 106 nears the end of its travel toward end 124 a small tab 304 projecting from the bottom of transverse arm 112 interacts with locking member 298 and moves it against the bias of spring 302 toward end 124 freeing lever 284 such that the chance wheel can be stopped.

As seen in FIGS. 7 and 8 pitching button 44 is mounted over a compression spring 306 near end 126 of lower housing 22. Sliding section 108 of movable member 106 contains a slot 308 in its upper surface. A finger 310 having a detent tooth 312 on the end thereof is integrally formed with pitching button 44. The detent tooth 312 is beveled on its upper surface such that when movable member 106 is pushed toward end 126 by reset lever 40 the end 314 of the sliding section 108 engages the beveled surface of finger 312 depressing the same until the slot 308 clears this beveled surface and under the influence of compression spring 306 the pitching button 44 pushes up and retains the slot 308 over the detent tooth 312. This holds the movable member 106 in a ready position. As soon as the pitching button 44 is pressed spring 122 pulls movable member 106 toward end 124 as previously discussed.

Two knobs 316 and 318 having knurled edges are located in lower housing 22 as shown in FIGS. 2 and 4. View windows 70 and 72 respectively expose a portion of each of these knobs. The upper surface of the knobs have the numerals 1 through 0 imprinted thereon. The portion of the knobs exposed through the view windows 70 and 72 correspond to that fraction of the knob which contains only one number. A small arc of each of the knobs is exposed through the side of the lower housing 22 and is accessible to manual manipulation by the player's fingers to the knobs 316 and 318 to maintain a record of each player's score. As seen in FIG. 4 inside of the knob 316 and 318 are ratchet-like surfaces 319 molded therein. Extending upwardly on lower housing 22 is a retention member 320 having two identical spring arms 322 each having a rounded section 324 on the end thereof. The rounded sections 324 fit within the ratchet surfaces 319 and correctly align the knobs 316 and 318 such that the desired number can be exposed through the viewing windows 70 and 72.

Figure 6:
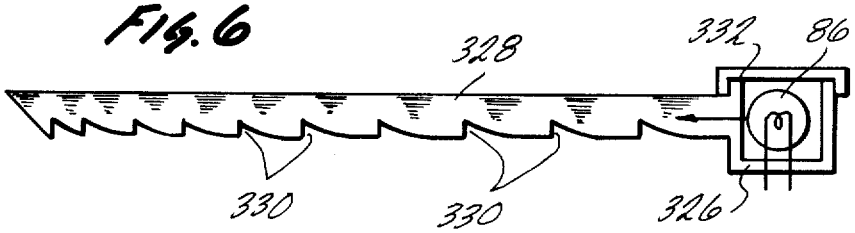
FIG. 6 is a side elevational view of a light propogating component located near the center of FIG. 2.

Light 84 is mounted within the interior of chance wheel 240. The chance wheel is printed with indicia on a dark background surface which allows for transmittal of light through that portion corresponding to the indicia. Thus, when light 84 is lit, the indicia transmits light and one of them is viewable through the view window 52. The second light 86 as seen in FIG. 2 is mounted near the chance wheel in a clear plastic housing 326 having an arm 328 extending therefrom. As seen in FIG. 6, which shows this arm in cross section, on the bottom of this arm there are a plurality of wedge-like cuts 330 formed therein. A black plastic cap 332 fits over light 86 and shields this light from view through view window 52. However, when this light is lit the light is propogated through the clear plastic arm 328 and reflected by the wedge cuts 330. Thus, when light 86 is lit a path of light is created underneath view window 52 which, when viewed through this window 52, appears to be the pathway of a ball leading from home plate 48 across the surface of the view window 52.

The game can be used by either one or two players. A brief description of a typical game between two players would be as follows. The off-on button 76 is turned to the on position to activate the electrical circuit. This lights LED 80. One player, normally the batter, pushes reset button 40 toward end 126 until the movable member 106 is locked in position near end 126 by the interaction of detent tooth 312 and slot 308. The other player, the pitcher, then secretly selects whether he will throw a ball or a strike by moving ball-strike button 74 to the appropriate position he desires; that is, he selects whether guide peg 136 will travel down either the strike pathway or the ball pathway. After making this selection he then depresses pitching button 44. This causes movable member 106 to travel toward end 124 or as viewed from the outside of the toy, LED 80 to travel from the pitcher's rubber toward home plate.

When the ball or the LED 80 nears home plate, the batter depresses batting button 50 to activate bat member 188. If the bat member 188 is activated at the same time that cylindrical section 232 is depressed by cam 226, switch 90 will be closed. If the pitcher had chosen the strike path then switch 88 would also be closed. Upon simultaneous closure of both switch 88 and 90, both lights 84 and 86 are lit. This in effect tells both players the batter has hit the ball. The pitcher then depresses defense button 54 which stops chance wheel 240. The particular indicia now exposed through viewing window 52 tells both players the outcome of the batter hitting the ball. Depending on whether it was an out, a single, etc., the players record the action via the buttons 56 through 60 as previously explained.

If the pitcher has chosen to pitch the ball down the ball pathway, switch 88 would never close and even if the batter depressed the batting button 50 when cylindrical section 232 was depressed by cam 226, the electrical circuit to lights 84 and 86 would not be completed. If the pitcher chose to use the strike pathway switch 88 would always close, but if the batter did not depress the batting button 50, depressed it too soon, or depressed it too late, switch 90 would not be closed, and the batter would be charged with a strike.

Aftei the ball, i.e., the LED 80, has traveled past home plate 48, the LED 80 comes to rest under one of two viewing squares 334 or 336 located on screen 26. If the LED 80 travels down the strike path it will rest under the strike square 334; if it travels down the ball path it will rest under the ball square 336.

The electrical circuit is powered by appropriate batteries 78 which are placed inside battery compartment 338. Off-on button 76 is connected to a slidable electrical contact 340 which slides on battery compartment 338 and makes appropriate electrical contact with contacts (not separately numbered) located thereon which activate the electrical circuit.

I claim:

1. A game which comprises:

a housing;

an object means movably mounted in said housing;

an object moving means mounted in said housing and moving said object means between a first location and a second location and including passing said object means through a strike location intermediate said first and said second locations;

a strike location determining means detecting when said object means is passing through said strike location;

a striking means movably mounted in said housing so as to move between a ready position and a strike termination position;

an activating means for actuating movement of said striking means from said ready position to said strike termination position;

detecting means operatively connected to said strike location determining means and detecting when said object means is passing through said strike location simultaneous with when said striking means is actuated.

2. The game of claim 1 including:

said object moving means moving said object means to at least one alternate second location wherein said object means does not pass through said strike location;

a pathway detection means for detecting when said object means moves to said second location;

said pathway detection means operatively connected to said detecting means such that said detecting means will detect when said object means is passing through said strike location simultaneous with when said striking means is actuated to move only when said object means moves to said second location.

3. The game of claim 2 wherein:

said object moving means includes a movable member, a guide means forming a guide for said movable member, and a propulsion means for propelling said movable member on said guide means;

said object means located on said movable member.

4. The game of claim 3 wherein:

said movable member includes a sliding member and an object means holding member;

said object means located on said object means holding member.

5. The game of claim 4 wherein:

said guide means includes a pathway means for guiding at least a portion of said object means holding member and a track;

said sliding member sliding on said track.

6. The game of claim 5 wherein:

said pathway means includes a first pathway and a second pathway;

said first location being located commonly in both said first pathway and said second pathway;

said second location and said strike location being located in said first pathway;

said alternate second location being located in said second pathway.

7. The game of claim 6 including:

said portion of said object means holding member fitting into said first and said second pathway guiding said object means holding member in a strike path and a miss path, said strike path corresponding to said first pathway, said miss path corresponding to said second pathway.

8. The game of claim 7 wherein:

said strike location determining means includes a locating member mounted on said sliding member and a locating member sensing means mounted in said housing proximal to said track;

said locating member contacting said locating member sensing means at said strike location as said sliding member is slid on said track.

9. The game of claim 8 wherein:

said strike location determining means includes a locating member mounted on said movable member and a locating member sensing means mounted in said housing proximal to said guide means;

said locating member contacting said locating member sensing means at said strike location as said movable member is propelled on said guide means;

said striking means includes a rotatably mounted strike member rotatable between said ready position and said strike termination position;

said activating means includes rotation means for rotating said strike member from said ready position to said strike termination position and an actuating member having a first position wherein said strike member is retained in said ready position and a second position wherein said strike member is released from said ready position and allowed to rotate to said strike termination position;

said pathway detection means includes a pathway trip lever located on said object means holding member and a pathway trip switch located on said housing such that said trip lever activates said trip switch when said object means is in said second position.

10. The game of claim 3 wherein:

said strike location determining means includes a locating member mounted on said movable member and a locating member sensing means mounting in said housing proximal to said guide means;

said locating member contacting said locating member sensing means at said strike location as said movable member is propelled on said guide means;

said striking means includes a rotatably mounted strike member rotatable between said ready position and said strike termination position;

said activating means includes rotation means for rotating said strike member from said ready position to said strike termination position and an actuating member having a first position wherein said strike member is retained in said ready position and a second position wherein said strike member is released from said ready position and allowed to rotate to said strike termination position.

11. The game of claim 3 including:

chance wheel means capable of randomly displaying any one of a plurality of different indicia located on said chance wheel means;

said chance wheel means operatively connected to said movable member so as to be activated by said movable member;

said detection means including indicia observation means allowing one of said plurality of indicia to be observed.

12. The game of claim 11 including:

stopping means for deactivating said chance wheel means;

said stopping means including player control means so as to allow said stopping means to be controlled by a player using the game.

13. The game of claim 12 wherein:

said strike location determining means includes a locating member mounted on said movable member and a locating member sensing means mounted in said housing proximal to said guide means;

said locating member contacting said locating member sensing means at said strike location as said movable member is propelled on said guide means;

said striking means includes a rotatably mounted strike member rotatable between said ready position and said strike termination position;

said activating means includes rotation means for rotating said strike member from said ready position to said strike termination position and an actuating member having a first position wherein said strike member is retained in said ready position and a second position wherein said strike member is released from said ready position and allowed to rotate to said strike termination position;

said pathway detection means includes a pathway trip lever location on said object means holding member and a pathway trip switch located on said housing such that said trip lever activates said trip switch when said object means is in said second position.

14. The game of claim 4 wherein:

said pathway detection means includes a pathway trip lever located on said object means holding member and a pathway trip switch located on said housing such that said trip lever activates said trip switch when said object means is in said second position.

15. The game of claim 14 wherein:

said strike location determining means includes a locating member mounted on said movable member and a locating member sensing means mounted in said housing proximal to said guide means;

said locating member contacting said locating member sensing means at said strike location as said movable member is propelled on said guide means;

said striking means includes a rotatably mounted strike member rotatable between said ready position and said strike termination position;

said activating means includes rotation means for rotating said strike member from said ready position to said strike termination position and an actuating member having a first position wherein said strike member is retained in said ready position and a second position wherein said strike member is released from said ready position and allowed to rotate to said strike termination position.

16. The game of claim 1 wherein:

said object moving means includes a movable member, a guide means forming a guide for said movable member, and a propulsion means for propelling said movable member on said guide means;

said object means located on said movable member.

17. The game of claim 16 wherein:

said strike location determining means includes a locating member mounted on said movable member and a locating member sensing means mounted in said housing proximal to said guide means;

said locating member contacting said locating member sensing means at said strike location as said movable member is propelled on said guide means.

18. The game of claim 17 wherein:

said striking means includes a rotatably mounted strike member rotatable between said ready position and said strike termination position;

said activating means includes rotation means for rotating said strike member from said ready position to said strike termination position and an actuating member having a first position wherein said strike member is retained in said ready position and a second position wherein said strike member is released from said ready position and allowed to rotate to said strike termination position.

19. The game of claim 18 wherein:

said strike location determining means includes a locating member mounted on said movable member and a locating member sensing means mounted in said housing proximal to said guide means;

said locating member contacting said locating member sensing means at said strike location as said movable member is propelled on said guide means;

said striking means includes a rotatably mounted strike member rotatable between said ready position and said strike termination position;

said activating means includes rotation means for rotating said strike member from said ready position to said strike termination position and an actuating member having a first position wherein said strike member is retained in said ready position and a second position wherein said strike member is released from said ready position and allowed to rotate to said strike termination position;

chance wheel means capable of randomly displaying any one of a plurality of different indicia located on said chance wheel means;

said chance wheel means operatively connected to said movable member so as to be activated by said movable member;

said detection means including indicia observation means allowing one of said plurality of indicia to be observed;

stopping means for deactivating said chance wheel means;

said stopping means including player control means so as to allow said stopping means to be controlled by a player using the game.

20. The game of claim 16 wherein:

said striking means includes a rotatably mounted strike member rotatable between said ready position and said strike termination position;

said activating means includes rotation means for rotating said strike member from said ready position to said strike termination position and an actuating member having a first position wherein said strike member is retained in said ready position and a second position wherein said strike member is released from said ready position and allowed to rotate to said strike termination position.

21. The game of claim 1 wherein:

said striking means includes a rotatably mounted strike member rotatable between said ready position and said strike termination position;

said activating means includes rotation means for rotating said strike member from said ready position to said strike termination position and an actuating member having a first position wherein said strike member is retained in said ready position and a second position wherein said strike member is released from said ready position and allowed to rotate to said strike termination position.

22. The game of claim 1 wherein:

said strike location determining means includes a locating member mounted on said movable member and a locating member sensing means mounted in said housing proximal to said guide means;

said locating member contacting said locating member sensing means at said strike location as said movable member is propelled on said guide means;

said striking means includes a rotatably mounted strike member rotatable between said ready position and said strike termination position;

said activating means includes rotation means for rotating said strike member from said ready position to said strike termination position and an actuating member having a first position wherein said strike member is retained in said ready position and a second position wherein said strike member is released from said ready position and allowed to rotate to said strike termination position.

23. The game of claim 22 including:

chance wheel means capable of randomly displaying any one of a plurality of different indicia located on said chance wheel means;

said chance wheel means operatively connected to said movable member so as to be activated by said movable member;

said detection means includes indicia observation means allowing one of said plurality of indicia to be observed.

* * * * *